US006199855B1

(12) United States Patent
Choeng et al.

(10) Patent No.: US 6,199,855 B1
(45) Date of Patent: Mar. 13, 2001

(54) PAPER FEEDING APPARATUS FOR OFFICE AUTOMATION SYSTEM

(75) Inventors: Sang-Won Choeng, Seoul; Jin-Ho Park; Heung-Kyu Jang, both of Kyonggi-do; Seung-Taik Hwang, Seoul, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/281,970

(22) Filed: Mar. 31, 1999

(30) Foreign Application Priority Data

Mar. 31, 1998 (KR) ..... 98/11319
May 29, 1998 (KR) ..... 98/19919

(51) Int. Cl.[7] ..... B65H 3/52; B65H 9/04
(52) U.S. Cl. ..... 271/122; 271/244; 271/245
(58) Field of Search ..... 271/122, 244, 271/245

(56) References Cited

U.S. PATENT DOCUMENTS 4,362,409 * 12/1982 Endo et al. ..... 400/625 X
4,428,666 * 1/1984 Phelps et al. ..... 355/14 X
5,648,808 * 7/1997 Yanagi et al. ..... 347/104 X
5,655,762 * 8/1997 Yergenson ..... 271/121
5,687,965 * 11/1997 Matsuda et al. ..... 271/241 X
5,775,684 * 7/1998 Jackson et al. ..... 271/9.07 X

* cited by examiner

*Primary Examiner*—Christopher P. Ellis
*Assistant Examiner*—Kenneth W Bower
(74) *Attorney, Agent, or Firm*—Robert E. Bushnell, Esq.

(57) ABSTRACT

A paper feeding apparatus for an office automation system constructed to accommodate the storage of paper, a sheet feeder that guides paper to travel in a selected direction of travel, and a device that aligns paper that is being stored to conform to the state of the feeder.

22 Claims, 10 Drawing Sheets

PAPER FEEDING APPARATUS FOR OFFICE AUTOMATION SYSTEM

CLAIM OF PRIORITY

This application makes reference to, incorporates the same herein, and claims all benefits accruing under 35 U.S.C. §119 from applications entitled Paper Feeding Apparatus For Office Automation System earlier filed in the Korean Industrial Property Office on Mar. 31, 1998, and there duly assigned Serial No. 11319/1998, and a second application entitled Paper Feeding Apparatus For Office Automation System and earlier filed in the Korean Industrial Property Office on May 29, 1998 and there duly assigned Serial No. 19919/1998.

BACKGROUND OF THE INVENTION

1. Field of the Invention

The present invention relates to a sheet feeding apparatus and processes generally, and, more particularly, to a paper feeding apparatus and process in an office automation system capable of preventing sheets of paper from deviating from the paper feeding apparatus during continuous feeding of the paper, realigning the paper for feeding while preventing more than one sheet from being fed and preventing occurrence of curl in the stationary sheets of paper.

2. Description of the Related Art

Office automation machinery includes image formation devices such as printers, facsimile transmission units, photocopies and scanners. Printers are used for creating documents by printing characters, symbols and images onto one exposed surface of a printable medium such as a cut sheet of paper that is fed into and transported through the printer, while scanners are used for reading and storing in image files characters, symbols and images from documents that have been fed into the scanner. A multi-functional office automation machine with the functions of both a printer and a scanner makes it possible for users to selectively use either one of these functions, in accordance with the desires of the user.

Since the aforementioned printers, scanners, or multi-functional office automation machines require the feeding of paper during printing, facsimile transmission, photocopy duplication or scanning, they are often equipped with some sort of paper feeding apparatus that feeds one or more sheets of paper to the machine. Papers stored in a paper tray, for example, are fed by the paper feeding apparatus, and are usually moved to a printing unit of the printer, photocopier or facsimile, or to the scanning unit of the scanner by the coordinated operation of several feed rollers. After images and characters of the document are either printed on the blank surface of the paper or read from the printed side of the document, the paper is then extracted through an outlet of the machine.

When printing or scanning is preformed by such paper feeding apparatus, the paper is usually continuously fed by one sheet after another sheet, beginning with the uppermost sheet in the stack of paper that is held by the apparatus. We have noticed however, that conventional paper feeding apparatus has an undesired tendency to simultaneously feed those sheets of paper that are stacked just below the uppermost sheet, together with the uppermost sheet, during the feeding operation of the apparatus. We have also found that this phenomenon occurs when the paper below the uppermost sheet is very thin, or has a curl at a particular portion of the sheet. I have also discovered that when a sheet of paper with such a curl is in contact with a separation finger that is disposed at both lower portions of the paper tray, the ears of the paper are all too often folded. This, in my opinion, frequently causes that sheet of paper to precipitate a problem during the course of the feeding operation, such as a paper jam within either the feeding apparatus for the image formation machine, a printing error, or scanning error. Moreover, when the paper is stored for a long time in a state standing at the feeding apparatus, a few sheets of the paper are abnormally fed to the separation finger along the resistance rib of the main frame of the paper feeding apparatus. Therefore, when the paper which is very thin or has a curl, is fed under the circumstance, the aforementioned abnormal paper feeding occurs.

SUMMARY OF THE INVENTION

It is therefore an object of the present invention to provide an improved process and apparatus for serially feeding cut sheets of paper from a stack of the paper.

It is another object to prevent more than one sheet of paper stored in a standing state on the paper feeding plane of a paper feeding apparatus, from being fed during a feeding cycle for one sheet, by adding a simple element to the apparatus.

It is still another object to prevent a few sheets of the paper from being abnormally fed into the paper feeding apparatus during a feeding cycle for a single sheet, by automatically realigning the remaining sheets below the uppermost sheet while feeding the uppermost sheet of paper.

It is yet another object to prevent a cam and a lever that are employed to prevent occurrence of paper curl from deviating from their normal positions.

It is still yet another object to provide apparatus and process in an office automation system capable of preventing sheets of paper from deviating from the paper feeding apparatus during continuous serial feeding of the paper from a stack, realigning paper remaining in the stack, preventing more than one sheet from being fed, and preventing occurrence of curl in the paper awaiting feeding.

These and other objects may be attained with a paper feeding process and device that may be installed in office automation apparatus. As contemplated in the practice of the principles of the present invention, the process may be implemented with a device that includes a storage tray able to hold a stack of cut sheet of paper, a feeding mechanism that serially feeds single sheets of paper from the stack in a selected direction, and an alignment mechanism that arranges sheets of paper remaining in the tray to conform to the state of the feeding mechanism. The alignment mechanism may be constructed with a first rotary shaft disposed over and spaced-apart by a selected distance from the tray, and a first eccentric cam that is preferably coupled to the first rotary shaft, varying the position of those sheets of paper stored on the tray by its rotation. Also, an ascent and descent component part is positioned at a contact face with the first eccentric cam, to ascend and descend relative to the pick-up plate of the tray in consonance with the rotation of the first eccentric cam.

The alignment mechanism may be constructed with a first lever that is rotated between a first position for supporting one-sided end of a sheet of paper so that the paper is aligned and a second position where support of the paper is released. The first lever is rotated in accordance with the feeding state of the feeding mechanism.

The tray may be constructed with a second pick-up plate that ascends and descends, a second rotary shaft disposed spaced-apart by a selected distance from the pick-up plate, and a second eccentric cam coupled to the second rotary shaft, for varying the position of the paper stored on the pick-up plate through the rotation of the second eccentric cam.

The alignment mechanism may be constructed with a guide lever that directs the second cam to rotate along a predetermined path of rotation. The first lever is selectively engaged with the feeding mechanism.

Selectively, the principles of the present invention may be practiced with a paper feeding device constructed with a first driving mechanism providing a reciprocating driving force that is generated simultaneously with the operation of the feeding mechanism, so that the first lever is rotated when the reciprocating driving force is applied through a rod that is hinge-coupled to the first lever. Preferably, either a cylinder solenoid or an electric motor may be used as the driving mechanism.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those having skill in the art.

Figure 1:
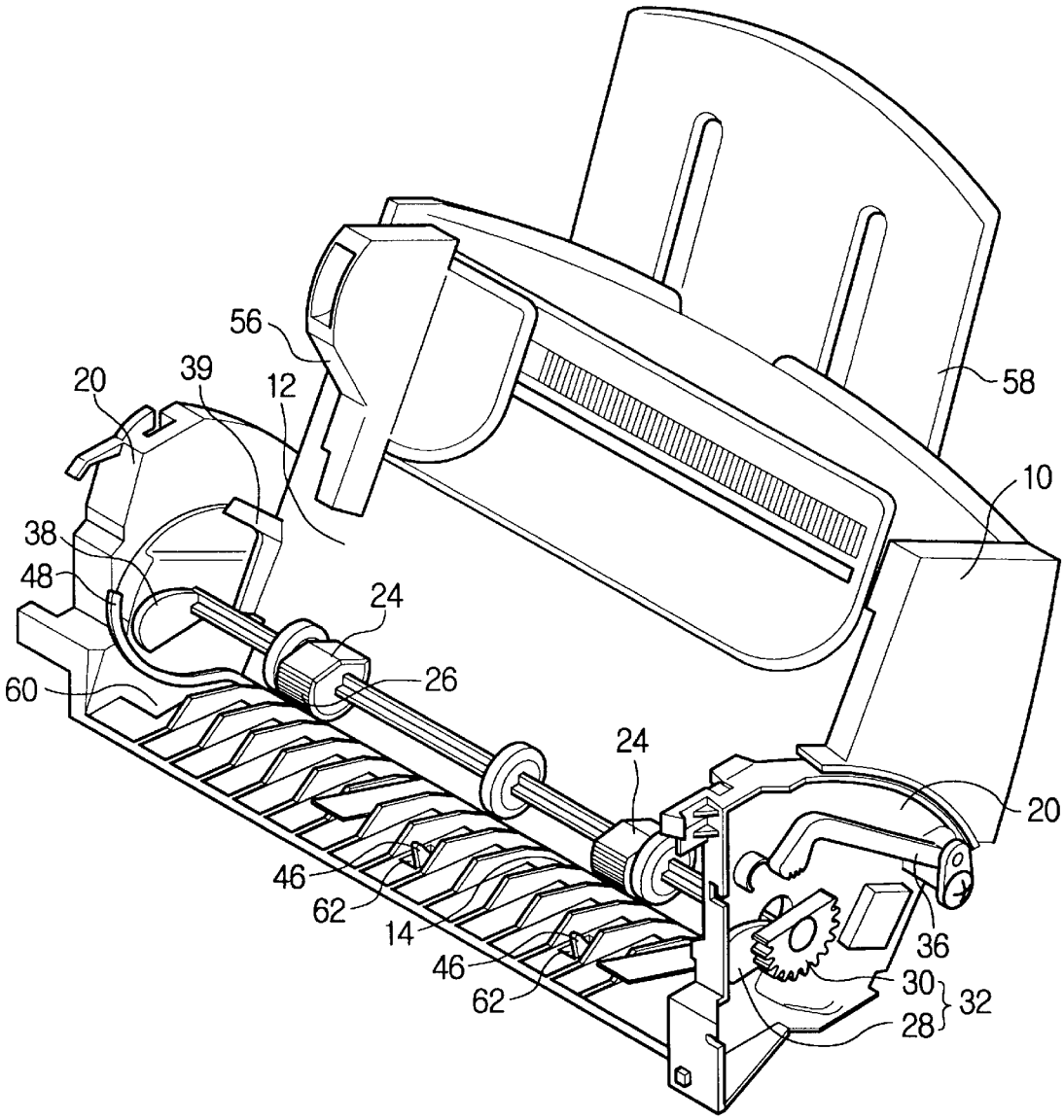
FIG. 1 is a perspective view of a paper feeding apparatus for an office automation system constructed as a first preferred embodiment of the principles of the present invention.
Figure 2:
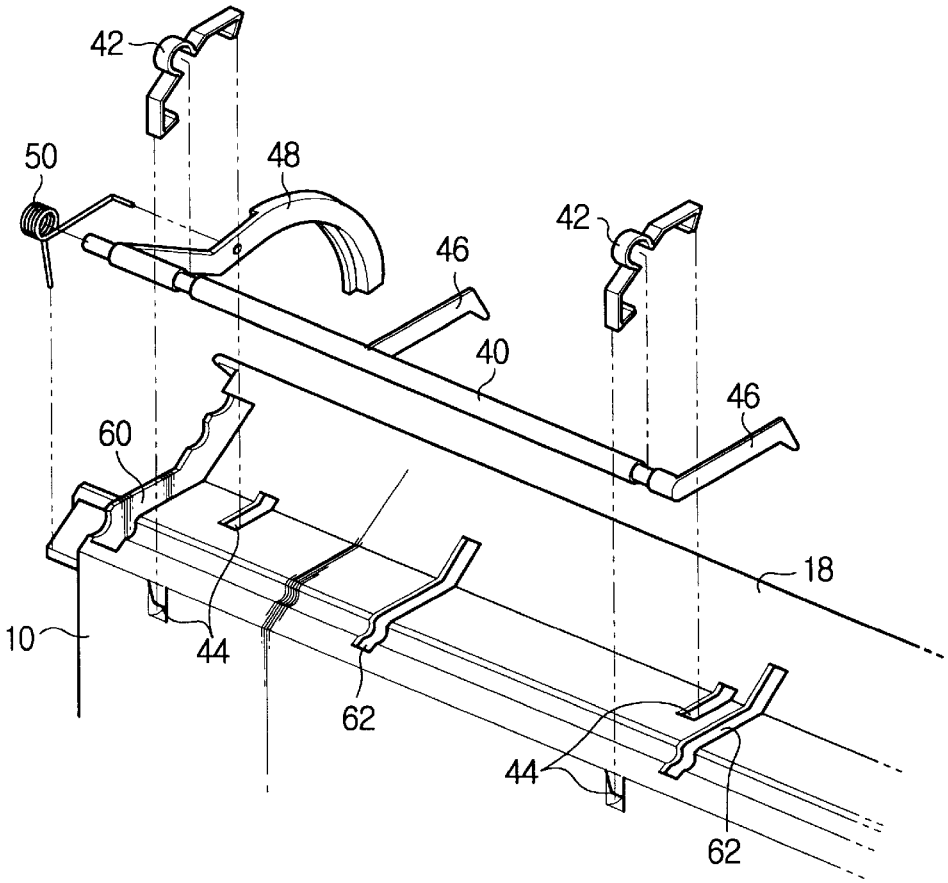
FIG. 2 is an exploded perspective view of the rear of the main frame shown in FIG. 1.

Referring first to FIGS. 1 and 2, a paper feeding apparatus constructed as a first preferred embodiment of the principles of the present invention includes a main frame 10 and a pick-up plate 12 which ascends and descends with respect to the bottom plate of the main frame 10. A spring (not shown) is disposed between the pick-up plate 12 and the bottom plate of the main frame 10 in order to provide an elastic force therebetween.

A resistance rib 18 is disposed standing at one end of the bottom plate of the main frame 10 and supports a paper supplied on the pick-up plate 12. The resistance rib 18 has a plurality of projection pieces 16 that are projected from the surface of the resistance rib 18 with a constant interval. The plurality of projection pieces 16 forms a paper end supporting plane 14 for supporting the ends of the paper mounted on the pick-up plate 12 at a selected position.

A pair of side frames 20 are disposed to both side walls of the bottom plate of the main frame 10, and coupled to the main frame 10 as one body. A rotation shaft (hereinafter referred to as "first rotary shaft") 22 is coupled to both the side frames 20. Two feed rollers 24 of hemi-circular plated shape are coupled to the first rotation shaft 22 apart from each other by a predetermined distance. Each of the two feed rollers 24 has a thin coated film of robber or urethan in order to enhance the feeding force of papers.

A cam assembly 32 including an inner cam 28 and an outer cam 30 is also coupled to the first rotation shaft 22. The inner cam 28 is disposed on the inner wall of one sided frame 20 and is applied for changing the position of the pick-up plate 12. The outer cam 30 disposed on the outer wall of the one side frame 20 and is coupled with a ratchet lever 36 disposed at the outer portion of the one sided frame 20.

An eccentric hemi-circular cam 38 is coupled to one sided end of the first rotation shaft 22 to be adjacent to the other sided frame 20. An ascent and descent member 39 for ascending and descending the pick-up plate 12 is disposed at one sided edge of the pick-up plate 10 as one body with the pick-up plate 12. The ascent and descent member 39 has an upper surface in which one end of the upper face thereof is curved upward, the upper surface being in contact with the outer circumferential surface of the eccentric hemi-circular cam 38 during the rotation of the eccentric hemi-circular cam 38. A lever rod is located at the rear of resistance rib 18. As shown in FIG. 2, the lever rod 40 is coupled by a pair of clips 42 to a bent portion of the rear of the resistance rib 18. Each of the pair of clips 42 includes a pair of extended portions each of which is firstly bent at an obtuse angle and is then secondly bent at an acute angle. Here, the pair of firstly bent portions of the clips 42 are respectively inserted into a pair of through holes 44 each of which is formed to be symmetric with respect to the main frame 10 and the resistance rib 18, thereby supporting the lever rod 40. Two stop levers 46 are respectively coupled to the lever rod 40 at the right angle, one being coupled to the mid portion of the lever rod 40 and the other to one end of the lever rod 40. At an portion adjacent to the other end of the lever rod 40, a guide lever 48 is coupled to the lever rod 40. A spring 50 is also coupled to the other end of the lever rod 40. The spring 50 has both ends which are extended to be crossed each other, thereby providing the stop lever 46 and the guide lever 48 with an elastic force. Here, the stop lever 46 has an end bent toward the standing paper mounted on the pick-up plate 12, and is rotated simultaneously with the movement of the guide lever 46.

Figure 3:
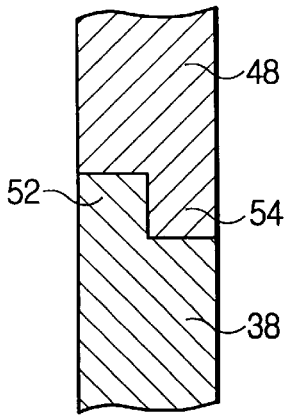
FIG. 3 is a partial sectional view showing one operational state with the hemi-circular cam and the guide lever in contact with each other.

The guide lever 48 and the hemi-circular cam 38 each has projections 52, 54 at their ends that are partially projected therefrom as shown in FIG. 3 such that they do not engage crisscross each other during relative displacement movement. Through holes 60, 62 are respectively formed at selected portions of the resistance rib 18 that correspond to the guide lever 48 and the pair of stop levers 46. A paper size controller 56 is equipped to the main frame 10 and is freely moved along the direction normal to the feeding direction of papers to align the papers according sizes of the papers as fed. A paper supporting member 58 supports the upper portion of the papers mounded on the pickup plate 12, and length thereof can be freely controlled.

In the aforementioned paper feeding apparatus, the first rotation shaft 22 is rotated as a rotation power that is provided from a motor (not shown) is applied to the first rotation shaft 22. The rotation of the first rotation shaft 22 allows the feed roller 24 to be rotated, and thereby each of the levers 46, 48 is operated simultaneously with the rotation of the first rotation shaft 22.

Figure 4:
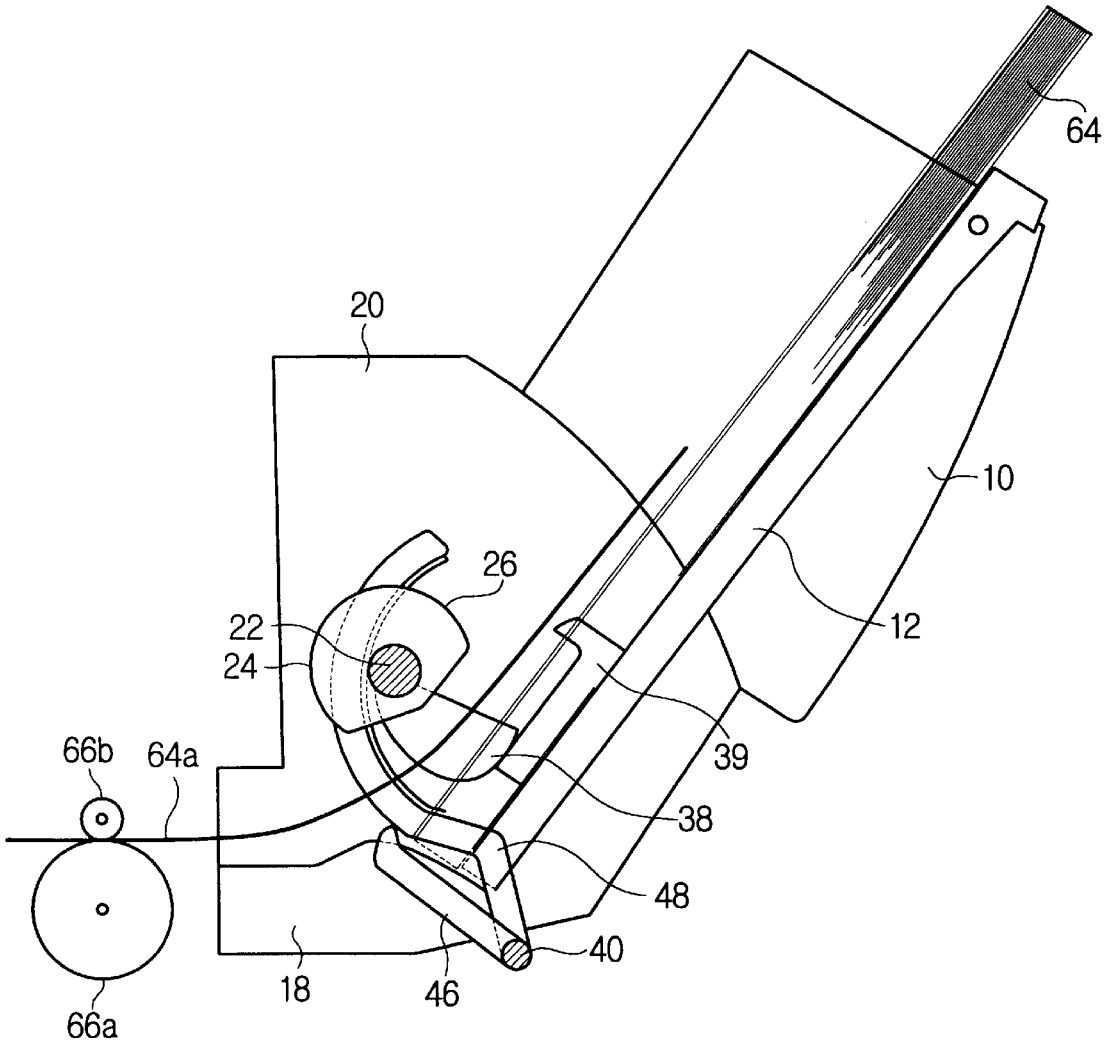
FIG. 4 is a simplified sectional view of FIG. 1 showing an operational state in which the paper is aligned.

When some sheets of the paper 64 are stocked on the pick-up plate 12, the hemi-circular cam 38 is positioned such that the section thereof is normal to the surface of the feeding paper 64 prior to the feeding of the paper 64 as shown in FIG. 4 The hemi-circular cam 38 is engaged with the ascent and descent member 39 in the descent state. In the descent state of the pick-up plate 12, the paper 64 is separated by a descent distance from the feed roller 24. At this time, the stop levers 46 passes through the through holes 62 by the elastic force of the spring 50, and are then projected to support the ends of the paper 64, thereby preventing paper 64 that is not in the feeding state from being abnormally fed. At this time, the guide lever 48 is placed to be adjacent to the first rotation shaft 22 by rotating simultaneously with the stop lever 46.

The paper 64 is supported upward by the paper end supporting plane 14 of the resistance rib 18, and paper which ends thereof are unevenly arranged are evenly aligned by the stop lever 46.

The uppermost sheet 64*a* of the paper 64 is continuously fed between a pair of rollers 66*a*, 66*b*. Here, feeding of the paper 64 into the region below feed roller 24 is not related with the feed roller 24 under the state of FIG. 4.

As the first rotation shaft 22 is rotated clockwise from the state of FIG. 4, the feed roller 24 and the hemi-circular cam 38 are accordingly rotated with the first rotation shaft 22. As the hemi-circular cam 38 is rotated clockwise from the state of FIG. 4 by a selected angle, the ascent and descent member 39 is released from the state supported by the hemi-circular cam 38, and accordingly the pick-up plate 12 ascends by the elastic power of the lower spring (not shown), whereby the pick up plate 12 is in contact with the uppermost sheet 64*a* of the feeding paper 64. Thereafter, as the feed roller 24 is further rotated clockwise over a critical angle, the uppermost sheet that is in contact with the hemi-circular surface 26 of the feed roller 24 is fed between the roller 66*a*, 66*b*. That is, as the first rotation shaft 22 is rotated clockwise by a predetermined angle from the state of FIG. 4, the pick-up plate 12 is released from the state pressed by the hemi-circular cam 30 as shown in FIG. 5 and thereby feeding of the paper 64 starts.

Figure 5:
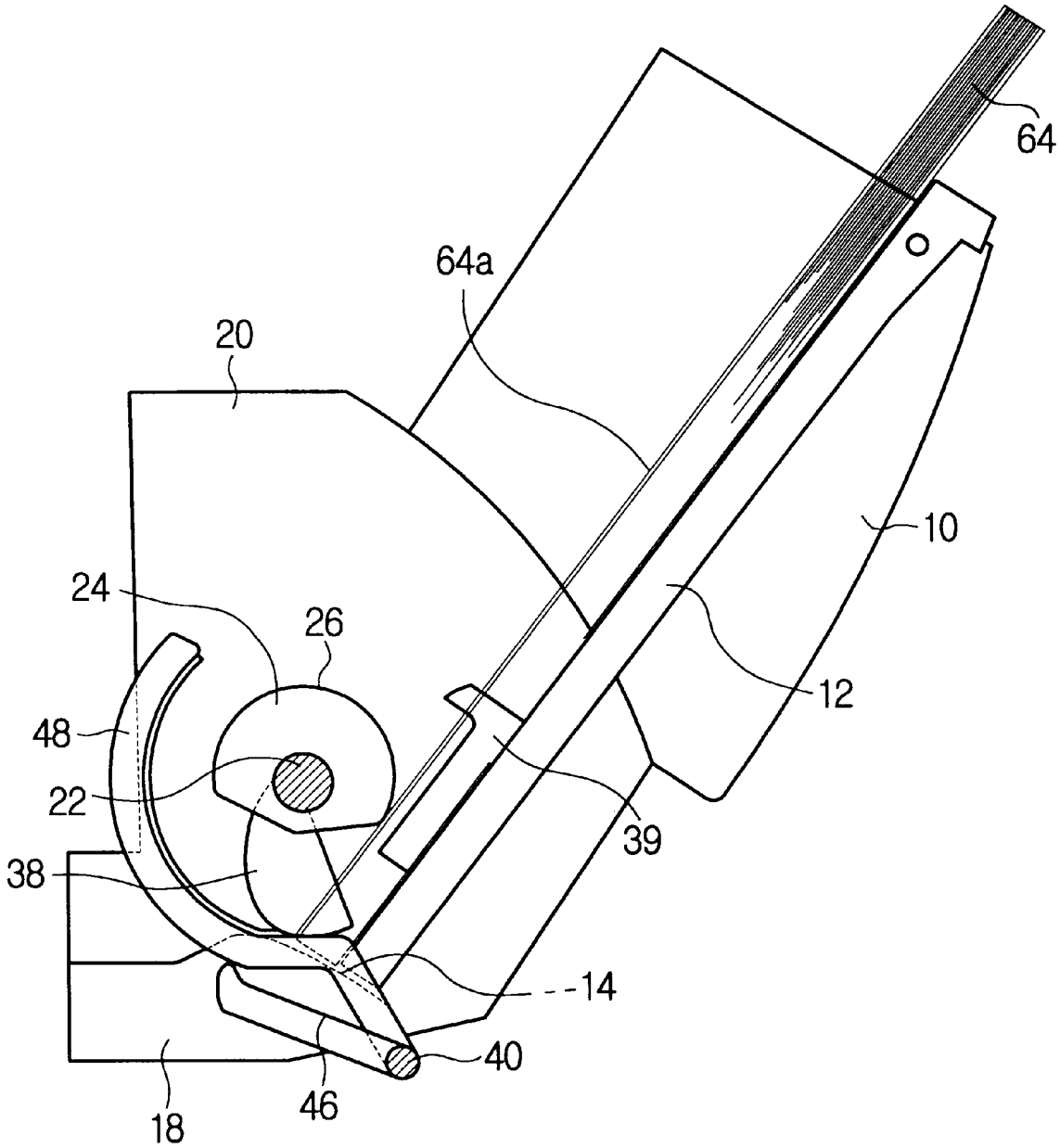
FIGS. 5 and 6 are simplified sectional views of FIG. 1 showing an operational state in which the paper is fed.

From the release state of the pick-up plate 12 as shown in FIG. 5, the hemi-circular cam 38 pushes the guide lever 48 toward the feeding direction of the paper 64, and thereby the guide lever 48 is pushed counterclockwise. The stop levers 46 are also rotated counterclockwise and are extracted from the through hole 60 as the guide lever 48 is rotated, and thereby upward support of the paper 64 by the stop lever 46 is released. Under the circumstance, the feed roller 24 feeds the uppermost sheet 64*a* downward.

Figure 6:
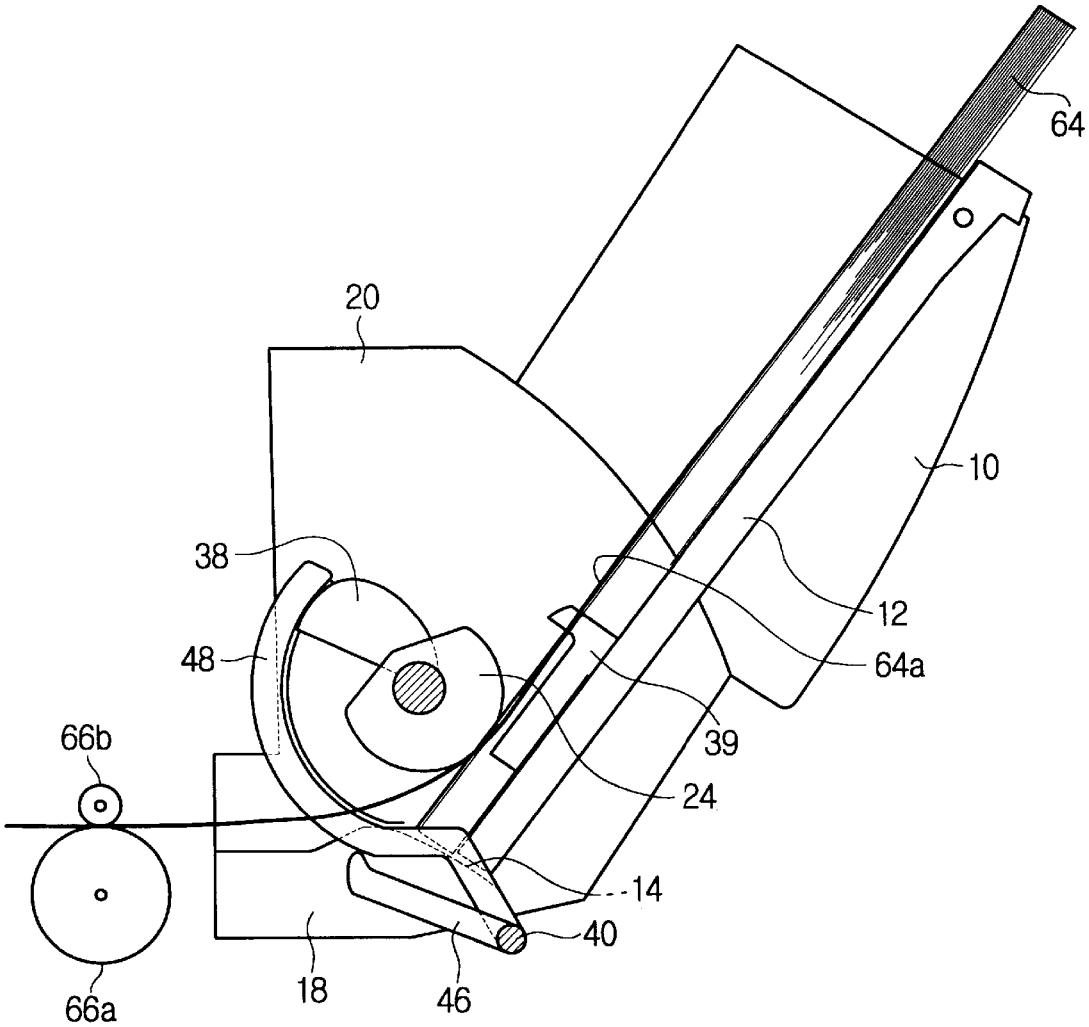

During the feeding of the uppermost sheet 64*a* as shown in FIG. 5, the first rotation shaft 22 continues to be rotated clockwise. The feed roller 24 and the hemi-circular cam 38 are also rotated as the first rotation shaft 22 is rotated, as shown in FIG. 6. By the rotation of the feed roller 24, the uppermost sheet 64*a* continues to be fed, and the hemi-circular cam 38 is guided along the inner curvature path of the guide lever 48 to be rotated.

As shown in FIG. 3, the guide lever 48 and the hemi-circular cam 38 each has a stepped end to be engaged with each other. Therefore, it is avoided that the guide lever 48 deviates from the end of the hemi-circular cam 38. Selectively, it can be constructed that the guide lever 48 has a projection rail and the hemi-circular cam 38 which is engaged with the projection rail has a recess rail, and vice-versa to obtain the same effect as that provided by the embodiment illustrated by FIG. 3. Although not shown in the drawings, the ascent and descent member 39 of the pick-up plate 12 that is in contact with the end of the hemi-circular cam 38 can be formed to have such a shape corresponding to the shape of the hemi-circular cam 38 and the shape of the end thereof. While the hemi-circular cam 38 is guided by the guide lever 48, the stop lever 46 is not projected upward and maintains the present position.

As the first rotation shaft 22 is further rotated clockwise by a predetermined angle from the state of FIG. 6, engagement between the hemi-circular cam 38 and the guide lever 48 is released. Accordingly, the stop lever 46 again passes through the through holes 62 of the resistance rib 18 by the elastic force of the spring 50, to thereby prevent papers right below the uppermost sheet 64*a* from being fed following the uppermost sheet 64*a*.

As the first rotation shaft 22 is still further rotated clockwise by a predetermined angle from the state of FIG. 6, the paper feeding device is restored to the initial state of FIG. 4. That is, the hemi-circular cam 38 again presses the ascent and descent member 39 such that the pick-up plate 12 descends. Resultantly, such a state that the paper below the uppermost sheet is pushed upward is released, and thereby the stored papers on the pick-up plate 12 is again aligned.

The aforementioned paper feeding device repeats the steps of FIG. 4 to FIG. 6, and the paper is fed by one sheet during such a cycle. Prior to feeding of the paper below the uppermost sheet after the uppermost sheet has been fed, the paper on the pick-up plate 12 is realigned. At this time, since the stop lever 46 supports the ends of the paper, feeding more than one sheet of he paper and curl generation are prevented. That is, the paper that is periodically fed is realigned by the ascent and descent of the pick-up plate 12, and simultaneously the end of the paper is also realigned by the stop levers 46 during the realignment of the paper, resulting in the prevention of the curl generation.

Thus, according to the above first embodiment, through the reinforcement of simple appliance, it is prevented that paper more than one sheet is abnormally fed and paper having a curl is abnormally fed, resulting in the prevention of the skew, paper being not fed, and paper jams. Meanwhile, so as to maximize such functions like the prevention of the curl generation and the paper support, the stop lever 46 can be varied in various shapes. For example, the stop lever 46 can be bent at least once such that the bent portion thereof has an obtuse angle as shown in FIGS. 7 and 8.

Figure 7:
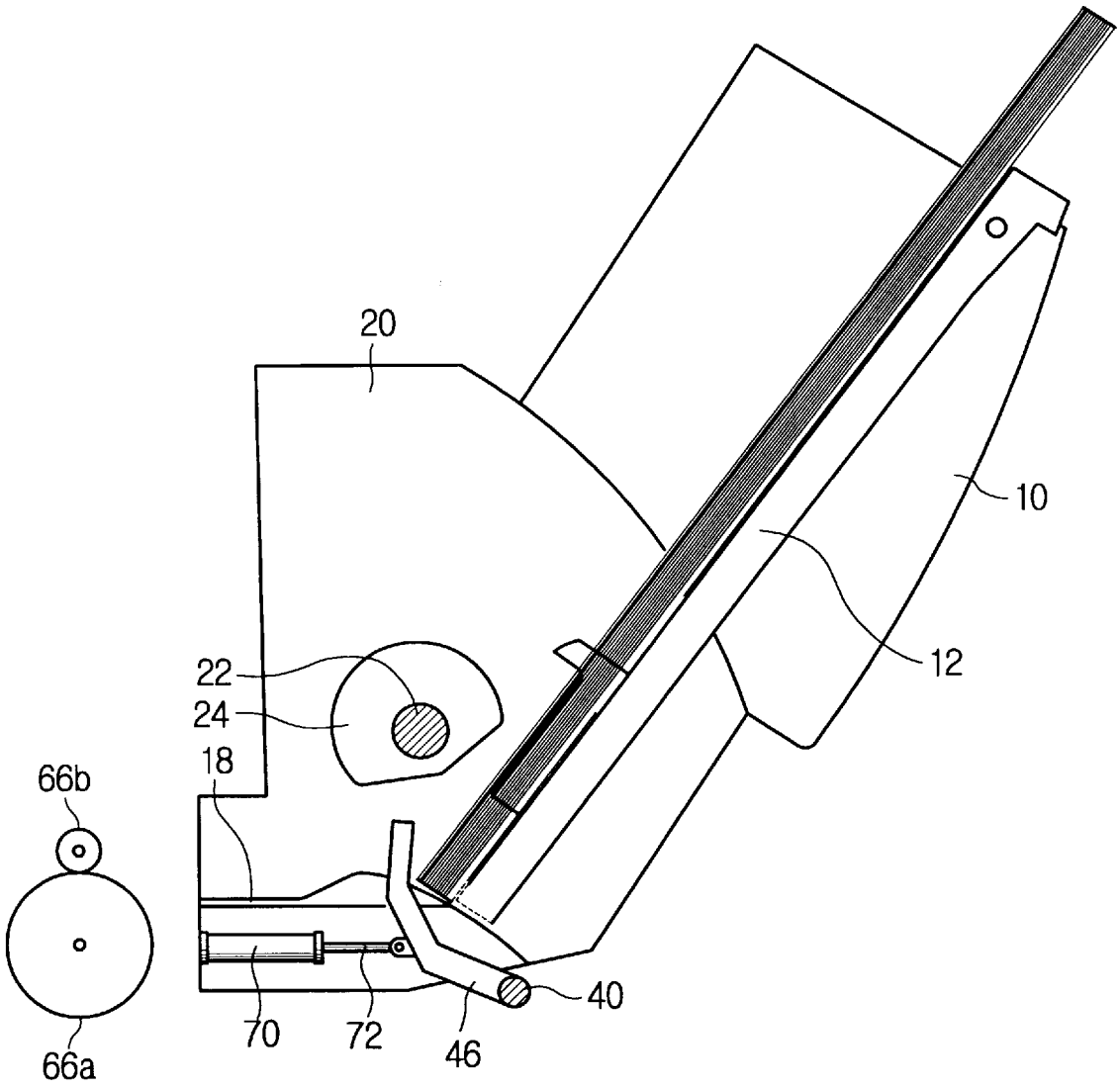
FIG. 7 is a simplified sectional view of the paper feeding apparatus constructed as a second preferred embodiment of the present invention.
Figure 8:
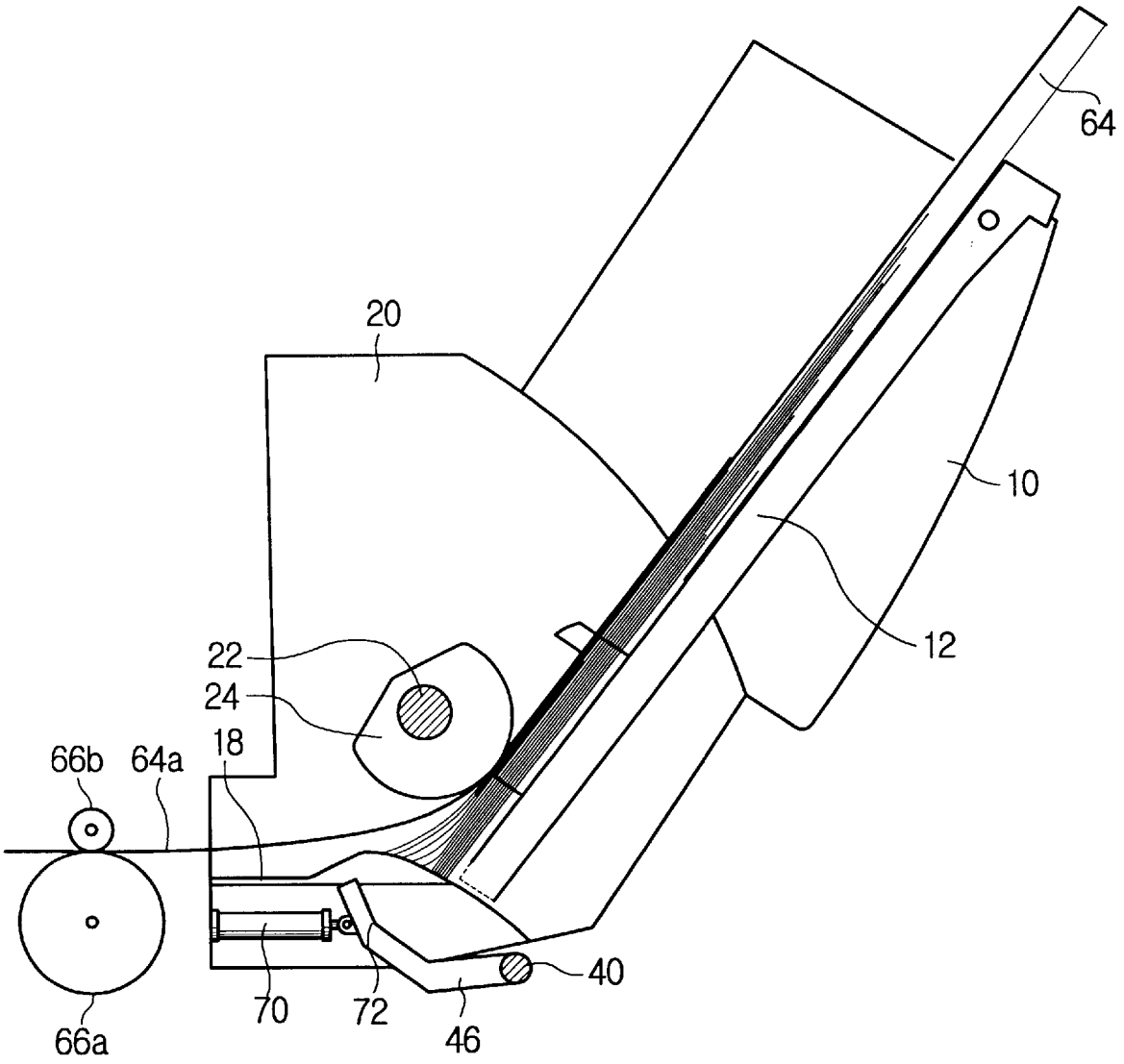
FIG. 8 is a simplified sectional view of the paper feeding apparatus of the second preferred embodiment of the present invention, showing one operational state while paper is being fed.

FIGS. 7 and 8 show the paper feeding apparatus according to a second embodiment of the present invention.

Referring to FIGS. 7 and 8, a stop lever 46*a* is coupled to a rotation shaft (hereinafter referred to as "second rotation shaft") 40*a* and can be structured such that it is pushed or pulled by a rod 72 of a solenoid cylinder 70. Specifically, the mid portion of the stop lever 46*a* is hinge-coupled to the rod 72 of the solenoid cylinder 70. Rod 72 pulls the stop lever 46*a* as shown in FIG. 7 when the paper starts to be fed, and pushes the stop lever 46*a* as shown in FIG. 8 when some sheets of papers has been fed or is stored. Through use of such the stop lever 46*a* driven by the solenoid cylinder 70, it is prevented that paper more than one sheet of the paper supported by the resistance rib 18 is fed, the paper is curled, and the curled paper is abnormally fed.

Figure 9:
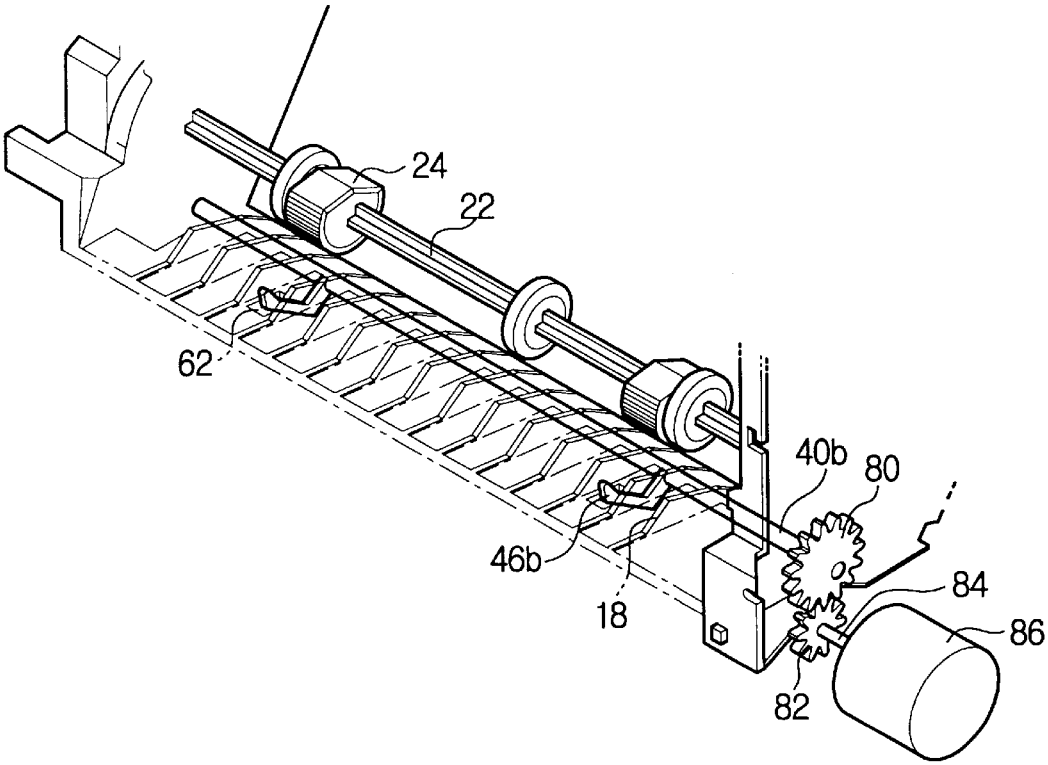
FIG. 9 is a partial sectional view of the paper feeding mechanism constructed as a third embodiment of the present invention.

Similarly to FIGS. 7 and 8, as a third embodiment to drive the stop lever 46*a*, another means such as an electric motor can be selectively used. Specifically, as shown in FIG. 9, a second rotation shaft 40*b* having a stop lever 46*b* is established at the rear of the resistance rib 18. The stop lever 46*b* is rotated as the second rotation shaft 40*b* is rotated, and goes in and out through the through holes 62 formed in the resistance rib 18. A gear 80 with large diameter (hereinafter referred to as "large gear") is coupled to one edge of the second rotation shaft 40*b* and a gear 82 with small diameter (hereinafter referred to as "small gear") is engaged with the large gear 80. The small gear 82 is coupled to a shaft 84 of a electric motor 86. Here, the electric motor 86 is constructed to have a specific rotation number with respect to the clockwise or counterclockwise rotation.

When the electric motor 86 is rotated clockwise or counterclockwise, the small gear 82 is firstly rotated at a first specific rotation number, the large gear 80 is rotated as the small gear 82 is rotated, and the stop lever 46*b* is rotated clockwise or counterclockwise as the large gear 80 is rotated.

Like the previous embodiments, through the application of the electric motor 86 for driving the stop lever 46*b*, it is prevented that the paper below the uppermost sheet is abnormally fed during one cycle and paper having a curl are normally fed, resulting in the prevention of the skew, paper being not fed, and the occurrence of jams during the feeding of the paper.

Figure 10:
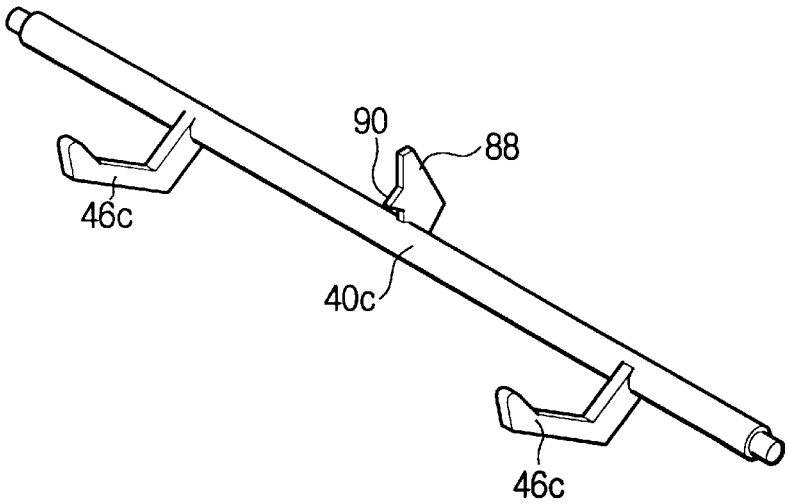
FIG. 10 is a perspective view of a rotary shaft in a paper feeding mechanism constructed as a fourth preferred embodiment of the present invention.

The rotation shaft according to the present invention can be also varied in various shapes. FIG. 10 shows a rotation shaft (hereinafter referred to as "third rotation shaft") 40*c* according to a fourth embodiment of the present invention. For convenience and ease of understanding, description for the same elements as previous previously in the discussion of other embodiments will be omitted in the following paragraphs.

Figure 11:
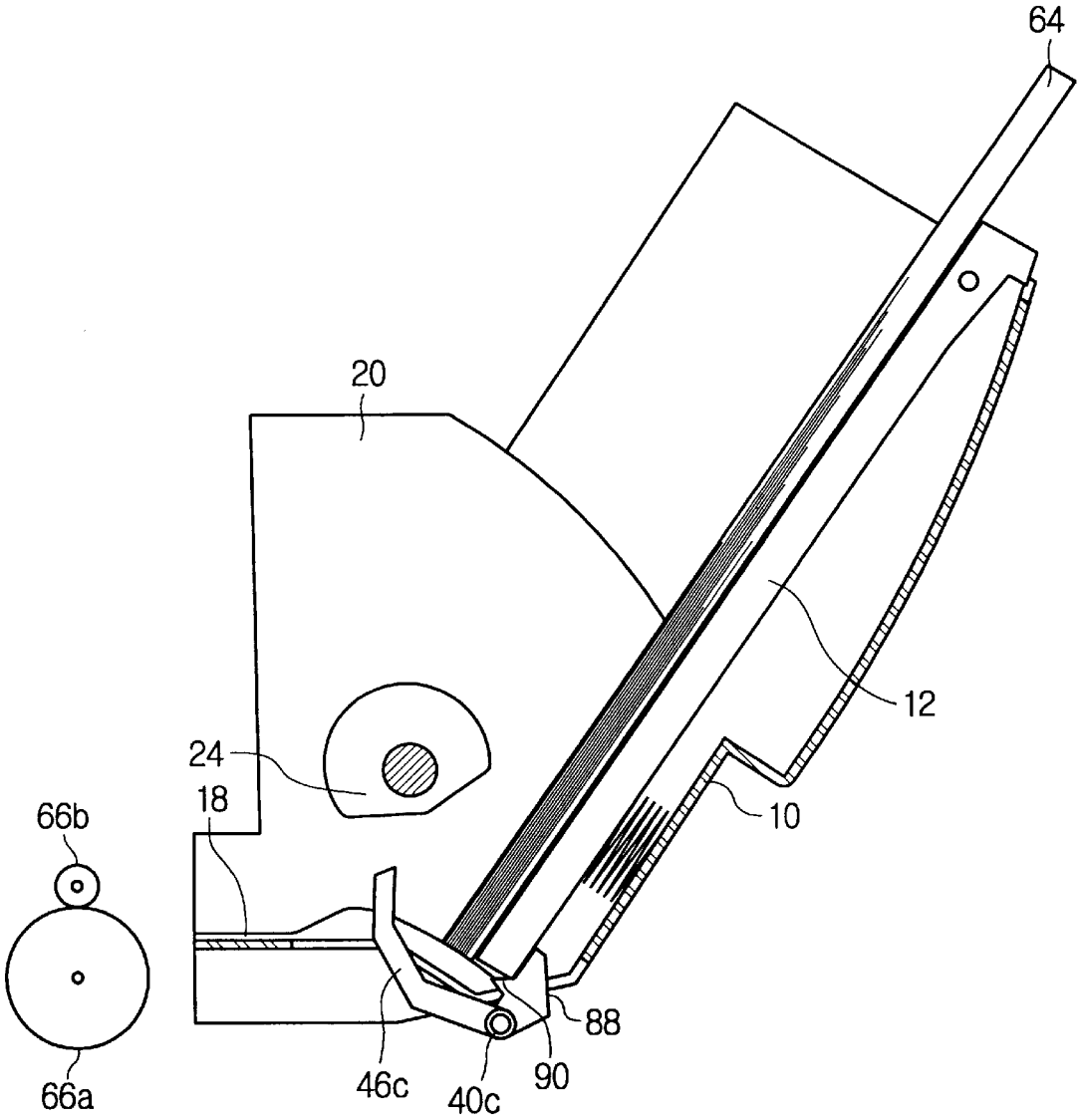
FIG. 11 is a simplified sectional view of the paper feeding apparatus of FIG. 10, showing that the paper is aligned by the stop lever.
Figure 12:
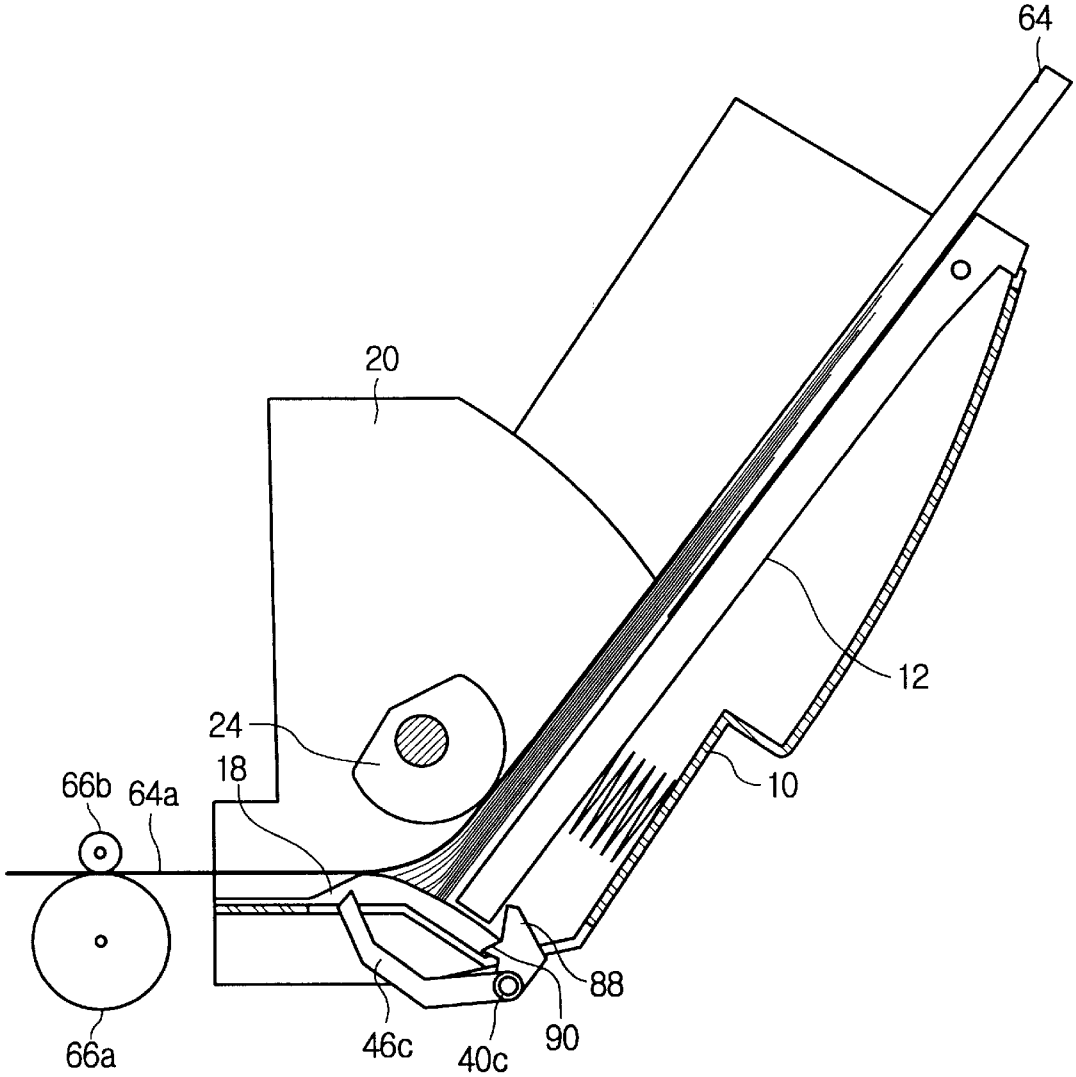
FIG. 12 is a simplified sectional view of the paper feeding apparatus of FIG. 10, showing an operational state while paper is fed.

Referring to FIG. 10, there is provided a pair of stop levers 46*c*. The pair of stop levers 46*c* are bent along the same direction and are apart from each other by a selected distance. The stopper 88 is disposed at mid portion between the pair of stop levers 46*c*, and is formed as one body with the third rotation shaft 40*c*. The stopper 88 has a projected portion 90 at a side wall thereof, the projected portion 90 is projected toward the feeding direction of the paper. The third rotation shaft 40*c* is also disposed at the rear of the resistance rib 18 as shown in FIGS. 11 and 12. The stopper 88 is disposed to pass through the through hole formed in the resistance rib 18. Like the first embodiment, the third rotation shaft 40*c* is coupled to gears and motor, and is driven to be rotated clockwise or counterclockwise by the rotation power that is supplied from the motor and gears.

The third rotation shaft 40*c* is rotated at the rear of the resistance rib 18, the stop levers 46*c* go in and out through the through holes formed in the resistance rib 18 as the third rotation shaft 40*c* is rotated, and the stopper 88 also goes in and out through a groove formed in the main frame 10.

Like the first and second embodiments, when the papers are not fed and are stored on the pick-up plate 12 in the paper feeding apparatus according to the fourth embodiment, the stop lever 46*c* is rotated as the third rotation shaft 40*c* is rotated clockwise, to thereby align the ends of the papers that are caught by the paper end supporting plane 14. At this time, the pick-up plate 12 is in the descent state. Afterwards, the ends of the paper 64 that are scattered while the uppermost paper is fed, is aligned by contacting with the inner surface of the bent stop lever 46*c* in rotation.

On the contrary, when the paper 64 is fed as shown in FIG. 12, the stop lever 46*c* is rotated counterclockwise as the third rotation shaft 40*c* is rotated counterclockwise and thereby the alignment state of the papers 64 aligned by the stop lever is released. Accordingly, the uppermost sheet 64*a* of the stored papers is in contact with the circular surface of the feed roller 24 and is then fed between the rollers 66*a* and 66*b*. At this time, the pick-up plate 12 is in the ascent state.

The rotation radius of the third rotation shaft 40*c* is determined by the stopper 88. Specifically, the projected portion 90 of the stopper 88 is rotated counterclockwise as the third rotation shaft 40*c* is rotated. During the rotation of the projected portion 90, the projected portion 90 is caught by the paper end supporting plane 14.

The aforementioned paper feeding apparatus may be applied not only to a typical document printer, but may also be applied to all paper feeding apparatus for an office automation system including a multi-functional machine that integrates the functions of a printer, a scanner and a facsimile transmission unit.

As described previously, the paper feeding apparatus of the present invention prevents the feeding paper from being curled by supporting the paper by the pair of stop levers, resulting in the prevention of the skew, paper being not fed, and paper jams. In addition, since unnecessary feeding of the paper below the uppermost sheet among the stored paper is prevented by the operation of the stop levers, occurrence of the skew or paper jam can be prevented. Moreover, since the hemi-circular cam and the guide lever have a projection structure corresponding to each other, it is prevented that the paper deviate from the fed state, resulting in maximizing the reliability in the paper feeding. Furthermore, since the curl generation of the paper for the feeding and abnormal paper feeding are prevented by adding a simple structured element, the fabrication cost is lowered.

The principles of this invention has been described in the foregoing paragraphs with reference to the several illustrated embodiments, as providing an apparatus and process that may be easily incorporated into office automation systems such as printers, scanners, photocopiers and facsimile transmission units, to prevent sheets of paper from deviating from the paper feeding apparatus during continuous, serial feeding of the sheets and realigning the sheets for feeding, while preventing more than one sheet from being fed into the apparatus and preventing occurrence of curl in the paper in the non-feeding state. It is evident, however, that many alternative modifications and variations will be apparent to those having skill in the art in light of the foregoing description. By way of example, although the foregoing embodiments have been described as applied to the handling, feeding and alignment of cut sheets of paper, the principles of the present invention may also be applied to other items of flat printable media such Mylar and overhead projection transparencies. Accordingly, the present invention embraces all such alternative modifications and variations as fall within the spirit and scope of the appended claims.

What is claimed is:

1. A paper feeding apparatus for an office automation system, comprising:

storing means for storing papers;

feeding means for feeding the papers in a selected direction; and aligning means for aligning the papers stored in said storing means according to a state of the feeding means.

2. The paper feeding apparatus according to claim 1, wherein said storing means comprises a first pick-up plate which ascends or descends, and said aligning means comprises a first rotation shaft disposed apart by a selected distance over said storing means; and a first eccentric cam of at least one coupled to said first rotation shaft, for varying position of the paper stored on said pick-up plate by the rotation of said first eccentric cam.

3. The paper feeding apparatus according to claim 2, wherein said rotation shaft comprises a hemi-circular plate shaped feed roller coupled thereto.

4. The paper feeding apparatus according to claim 2, wherein said pick-up plate comprises an ascent and descent part for ascending and descending said pick-up plate by rotation of said first eccentric cam.

5. The paper feeding apparatus according to claim 4, wherein said ascent and descent member is engaged with said first eccentric cam during the rotation of said eccentric cam.

6. The paper feeding apparatus according to claim 5, wherein said first eccentric cam has a stepped outer circumferential surface and said ascent and descent member has an stepped upper surface, said upper surface being partially in contact with said stepped outer circumferential surface of said first eccentric cam during the rotation of said first eccentric cam.

7. The paper feeding apparatus according to claim 5, wherein said first eccentric cam has a projection rail and said ascent and descent member has a recess rail that is engaged with said projection rail.

8. The paper feeding apparatus according to claim 1, wherein said aligning means comprises a rotatable aligning lever of at least one, said aligning lever being rotated between a first position for supporting one-sided end of said paper such that said paper is aligned and a second position where supporting said papers is released, said aligning lever being rotated according to a feeding state of said feeding means.

9. The paper feeding apparatus according to claim 8, wherein said storing means comprises a main frame and a resistance rib extended from said main frame, for supporting one-sided end of the paper mounted on said pick-up plate at a selected position, said resistance rib comprising a through hole in which said aligning lever goes in and out during the rotation of said aligning lever.

10. The paper feeding apparatus according to claim 8, wherein said storing means comprises a second pick-up plate which ascends or descends, a second rotation shaft disposed apart by a selected distance over said pick-up plate; and a second eccentric cam of at least one coupled to said second rotation shaft, for varying position of the paper stored on said pick-up plate by the rotation of said second eccentric cam.

11. The paper feeding apparatus according to claim 10, wherein said aligning means comprises a guide lever which guides said second cam to be rotated with a predetermined rotation path.

12. The paper feeding apparatus according to claim 11, wherein said guide lever is engaged with said second cam during the rotation of said second cam.

13. The paper feeding apparatus according to claim 12, wherein said guide lever has a first stepped end at inner curved surface thereof and said second cam has a second stepped end at outer circumferential surface, said first stepped end is engaged with said second stepped end.

14. The paper feeding apparatus according to claim 12, wherein said guide lever has a projection rail and said second eccentric cam has a recess rail that is engaged with said projection rail guide lever, said projection rail being engaged with said recess rail.

15. The paper feeding apparatus according to claim 8, wherein said aligning lever is engaged with said feeding means and is rotated simultaneously with said feeding means.

16. The paper feeding apparatus according to claim 8, further comprising a first driving means for providing a reciprocation driving force which is generated simultaneously with operation of said feeding means, wherein said aligning lever is rotated when said reciprocation driving force is applied through a rod which is hinge-coupled with said aligning lever.

17. The paper feeding apparatus according to claim 16, wherein said driving means is a solenoid cylinder.

18. The paper feeding apparatus according to claim 16, wherein said driving means is an electric motor.

19. The paper feeding apparatus according to claim 8, wherein said aligning lever is coupled to said first rotation shaft, a first gear is axial-coupled to one sided end of said first rotation shaft, and said first gear is engaged with driving means for generating a rotation force by being driven simultaneously with operation of said feeding means.

20. The paper feeding apparatus according to claim 19, wherein said driving means comprises:

a second gear in a mesh with said first gear;

a second electric motor; and a rotation shaft connected between said second gear and said electric motor.

21. The paper feeding apparatus according to claim 8, wherein said rotation lever further comprises a stopper formed at mid portion, for determining rotation range of said aligning lever.

22. The paper feeding apparatus according to claim 21, wherein said stopper comprises a projected portion.

* * * * *